US007766146B2

(12) United States Patent
Nakatsuka et al.

(10) Patent No.: US 7,766,146 B2
(45) Date of Patent: Aug. 3, 2010

(54) CURRENCY RECEIVING/DISPENSING MACHINE

(75) Inventors: Shigeki Nakatsuka, Hyogo-Ken (JP); Yoshikatsu Mizushima, Himeji (JP)

(73) Assignee: Glory Ltd., Hyogo-Ken (JP)

( * ) Notice: Subject to any disclaimer, the term of this patent is extended or adjusted under 35 U.S.C. 154(b) by 0 days.

(21) Appl. No.: 11/794,193

(22) PCT Filed: Dec. 24, 2004

(86) PCT No.: PCT/JP2004/019395

§ 371 (c)(1),
(2), (4) Date: Jun. 22, 2007

(87) PCT Pub. No.: WO2006/067858

PCT Pub. Date: Jun. 29, 2006

(65) Prior Publication Data

US 2008/0047801 A1 Feb. 28, 2008

(51) Int. Cl.
*G07F 7/04* (2006.01)

(52) U.S. Cl. ..... 194/206

(58) Field of Classification Search ..... 194/206
See application file for complete search history.

(56) References Cited

U.S. PATENT DOCUMENTS 5,900,607 A * 5/1999 Awatsu et al. ..... 235/379

FOREIGN PATENT DOCUMENTS

| | | |
|---|---|---|
| JP | 01-251165 | 10/1989 |
| JP | 02-287689 | 11/1990 |
| JP | 10-105771 | 4/1998 |
| JP | 10-269412 | 10/1998 |
| JP | 2004-145600 | 5/2004 |

OTHER PUBLICATIONS

International Search Report of Mar. 13, 2005 for PCT/JP2004/019395.
Partial translation of relevant parts of JP 60-19293 (Jan. 31, 1985).
Partial translation of relevant parts of JP 02-287689 (Nov. 27, 1990).
Partial translation of relevant parts of JP 01-251165 (Oct. 6, 1989).
Computer translation of JP 10-269412 (Oct. 9, 1998).
Computer translation of JP 10-105771 (Apr. 24, 1998).
Computer translation of JP 2004-145600 (May 20, 2004).

* cited by examiner

*Primary Examiner*—Patrick Mackey
*Assistant Examiner*—Mark Beauchaine
(74) *Attorney, Agent, or Firm*—Renner. Kenner, Greive, Bobak, Taylor & Weber

(57) ABSTRACT

A currency receiving/dispensing machine comprises a currency receiving opening, identifying means for transferring currency set into the currency receiving opening and for identifying the currency, a currency storing section for storing the currency in a predetermined place based on a currency receiving approving instruction and a result of identification of the identifying means, a currency dispensing opening through which the currency taken out from the currency storing section is dispensed based on a currency dispensing instruction, and mode designating means for switching and designating various operation modes, wherein the currency receiving/dispensing machine has two kinds of maintenance modes for carrying out maintenance and inspection of the currency receiving/dispensing machine designated by the mode designating means, the two kinds of maintenance modes comprises a first maintenance mode in which currency can not be taken out from the currency storing section, and a second maintenance mode in which currency can be taken out from the currency storing section.

6 Claims, 8 Drawing Sheets

CURRENCY RECEIVING/DISPENSING MACHINE

TECHNICAL FIELD

The present invention relates to a currency receiving/dispensing machine, and more particularly, to improvement of security of currency handling when maintenance and inspection are carried out for a currency receiving/dispensing machine which carries out currency receiving processing for taking-in and identifying currency put into a currency receiving opening for storing the currency in a currency storing section based on a currency receiving approval instruction, and currency dispensing processing for taking out the currency from the currency storing section and dispenses out the same into a currency dispensing opening based on a currency dispensing instruction.

BACKGROUND ART

In financial institutions or the like, there is widely used, as a machine handled by a teller, the currency receiving/dispensing machine which carries out currency receiving processing for transferring and identifying currency put into a currency receiving opening for storing the currency in a currency storing section based on a currency receiving approving instruction, and currency dispensing processing for taking out the currency from the currency storing section and dispenses out the same into a currency dispensing opening based on a currency dispensing instruction.

Japanese Patent Application Laid-open No. 2004-145600 describes a typical conventional art of this currency receiving/dispensing machine.

It is described in this document that this currency receiving/dispensing machine can handle only bills but it can also handle coins in general.

In the case of a bill receiving/dispensing machine, the machine is roughly divided into an upper unit and a lower unit. The upper unit includes a currency receiving opening which bills to be received is set, a currency dispensing opening from which bills to be paid is dispensed, a temporary holder in which bills identified and counted when they are received are temporarily hold, and an identifying section for determining genuine/counterfeit, normal/damaged and kinds of currency. The lower unit includes a plurality of bill storing section for respective kinds of currency. Bills to be received and bills to be paid are stored therein on the kind-by-kind basis.

The lower unit can be used as a large currency safe, and to enhance the safety, it is possible to dispose a combination lock for locking and unlocking a front door of the currency safe by inputting a password.

Such a currency receiving/dispensing machine generally has an RAS (Reliability, Availability and Serviceability) program for executing an RAS function to carry out the maintenance and inspection, and the currency receiving/dispensing machine can be brought into an RAS mode. In the RAS mode, it is possible to carry out operation confirmation of bill handling processing such as currency receiving processing, currency dispensing processing, replenishing processing and withdrawal processing; initial resetting processing for operating various mechanisms, and operation confirmation processing for confirming operation states of sensors and driving sections such as motors. The maintenance and inspection by the RAS mode are carried out periodically by a maintenance person of a machine sales company.

If the currency receiving/dispensing machine is brought into the RAS mode, the currency receiving/dispensing machine is brought into a vulnerable state where any person can freely take out bills in the bill storing section by the currency dispensing processing and withdrawal processing, and there is a danger that bills are lost.

Thus, a security plug has been developed to limit a person who can enter the RAS mode, As shown in FIG. 1, the security plug has a small box 1 having a circuit therein, a cord 2 extending from the box 1, and a connector plug 3 (e.g., USB plug) which provided on a tip end of the cord 2 for engaging with a connector of a body. By connecting the plug 3 with a predetermined position in a device at the time of the maintenance, e.g., with a control substrate, the currency receiving/dispensing machine is not brought into the RAS mode unless the control substrate confirms that a specific cord generated from the circuit incorporated in the box 1 matches with a cord which is to be permitted. This security plug is handed over only to a reliably person in charge having a constant level of right such as a manager and a maintenance person. Thus, the security can largely be enhanced.

The maintenance operation using such a security plug will be explained with respect to a flowchart shown in FIG. 2.

First, an upper unit key borrowed from a banker is inserted to unlock the key which fixes the upper unit to the body (step S101).

With this, the upper unit can be pulled out and thus, the upper unit is pulled out (step S102).

An RAS security plug is mounted on a connector provided on a control substrate which appears in this pulled out state (step S103).

Similarly, a remote/local mode switch in an operating section which appears in the state where the upper unit is pulled out is switched to the local side (step S104).

The upper unit is returned into the body and set, and a power supply switch is turned ON (step S105).

Next, an RAS actuation commands "FF" and "START" in the RAS operating section are depressed (step S106).

With this, a mechanical key of a lower currency safe door is brought into an operable state. Thus, the, key is turned in the clockwise direction, a currency safe door open/close lever is operated and the currency safe door is opened (step S107).

With the above operations, the actuation of RAS is completed. Thus, the maintenance operation can be continued using all of the RAS commands thereafter.

Patent Document 1: Japanese Patent Application Laid-open Publication No. 2004-145600

DISCLOSURE OF THE INVENTION

However, the conventional currency receiving/dispensing machine has the following problems.

Firstly, if the currency receiving/dispensing machine is once brought into the RAS mode, not only the person in charge having the security plug but also anybody can take out bills in the bill storing section by the currency dispensing processing and withdrawal processing. Thus, there is a problem that a manager of a bank or the like must monitor while the maintenance person is carrying out the maintenance and inspection.

Secondary, since only a specific person has the security plug, the security plug must be managed with exactitude, and it is troublesome to manage the security plug.

Hence, it is an object of the present invention to provide a currency receiving/dispensing machine having high security without using a security plug.

According to a first aspect of the present invention, there is provided a currency receiving/dispensing machine comprising a currency receiving opening, identifying means for transferring currency set into the currency receiving opening and for identifying the currency, a currency storing section for storing the currency in a predetermined place based on a currency receiving approving instruction and a result of identification of the identifying means, a currency dispensing opening through which the currency taken out from the currency storing section is dispensed based on a currency dispensing instruction, and mode designating means for switching and designating various operation modes, wherein the currency receiving/dispensing machine has two kinds of maintenance modes for carrying out maintenance and inspection of the currency receiving/dispensing machine designated by the mode designating means, the two kinds of maintenance modes comprises a first maintenance mode in which currency can not be taken out from the currency storing section, and a second maintenance mode in which currency can be taken out from the currency storing section.

According to a second aspect of the invention, there is provided a currency receiving/dispensing machine comprising a currency receiving opening, identifying means for transferring currency set into the currency receiving opening and for identifying the currency, a currency storing section for storing the currency in a predetermined place based on a currency receiving approving instruction and a result of identification of the identifying means, a currency dispensing opening through which the currency taken out from the currency storing section is dispensed based on a currency. dispensing instruction, wherein the currency receiving/dispensing machine has a plurality of maintenance modes, first maintenance mode designating means for designating a first maintenance mode in which currency can not be taken out from the currency storing section, second maintenance mode designating means for designating a second maintenance mode in which currency can be taken out from the currency storing section by input having higher security level than the first maintenance mode designating means, and control means which permits maintenance and inspection other than the currency storing section and prohibits a currency dispensing command for transferring currency at least from the currency storing section when the first maintenance mode is designated by the first maintenance mode designating means, and which permits all of maintenance and inspections including the currency storing section and permits the currency dispensing command for transferring currency from the currency storing section when the second maintenance mode is designated by the second maintenance mode designating means.

EFFECT OF THE INVENTION

According to the present invention, the currency receiving/dispensing machine is characterized in that it has two security levels, i.e., an RAS at a security level 0 in which in the RAS which can be operated even when there is no cash manager (banker in bank), if bills exist in the device, i.e., if all of counters are not 0, in which a currency dispensing command and a RAM clearing command for instructing the currency dispensing processing and the withdrawal processing can not be used; and an RAS at a security level 1 in which the RAS can not be actuated until the combination lock is unlocked by a cash manager (banker in bank) and all of commands are permitted. Therefore, it is possible to carry out the maintenance operation of operation confirmation of various mechanism portions without restraining the banker in time in a normal maintenance, i.e., maintenance operation of operation confirmation of processing from reception to collection in the temporary holder. When there is cash in the currency safe of the device, the maintenance operation is carried out when the cash manager attends and operates, and strict cash management can be carried out, and a customer can reliably ask the maintenance operation.

BEST MODE FOR CARRYING OUT THE INVENTION

An embodiment of the present invention will be explained in detail with reference to the drawings.

Figure 1:
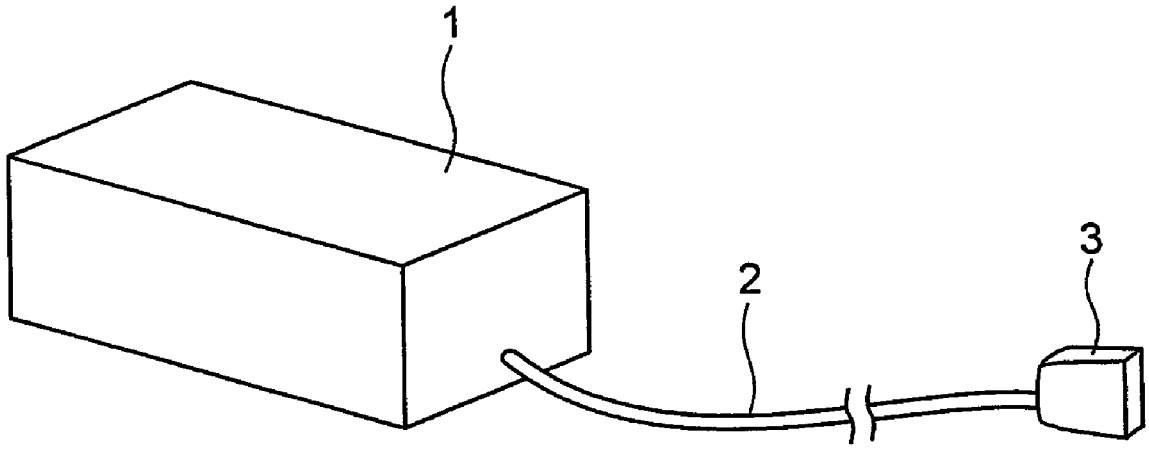
FIG. 1 PRIOR ART
FIG. 1 is a perspective view of an RAS security plug used for executing a conventional RAS mode.
Figure 2:
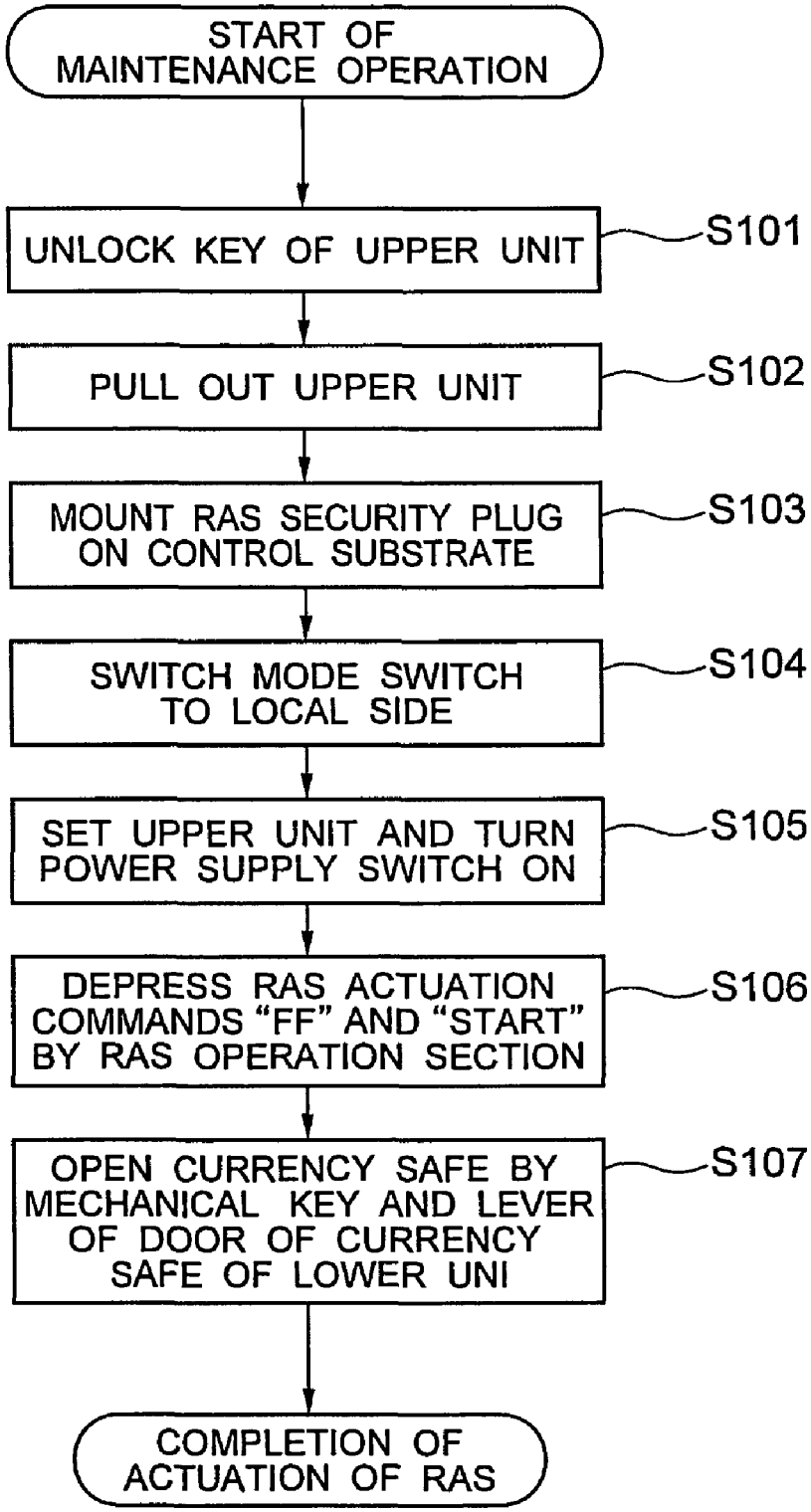
FIG. 2 PRIOR ART
FIG. 2 is a flowchart showing procedure of a maintenance operation in a conventional currency receiving/dispensing machine.
Figure 3:
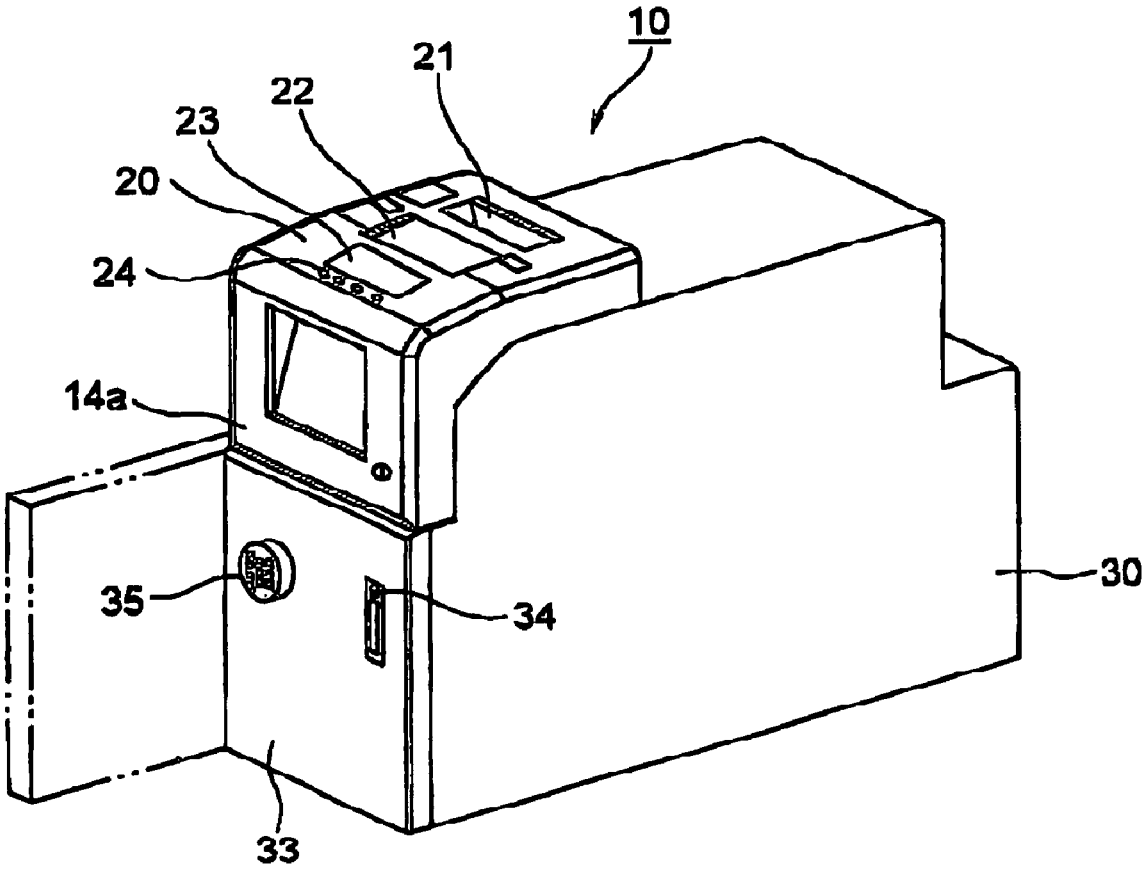
FIG. 3 is a perspective view showing an outward appearance of a bill receiving/dispensing machine as one example of the currency receiving/dispensing machine to which the present invention is applied.
Figure 4:
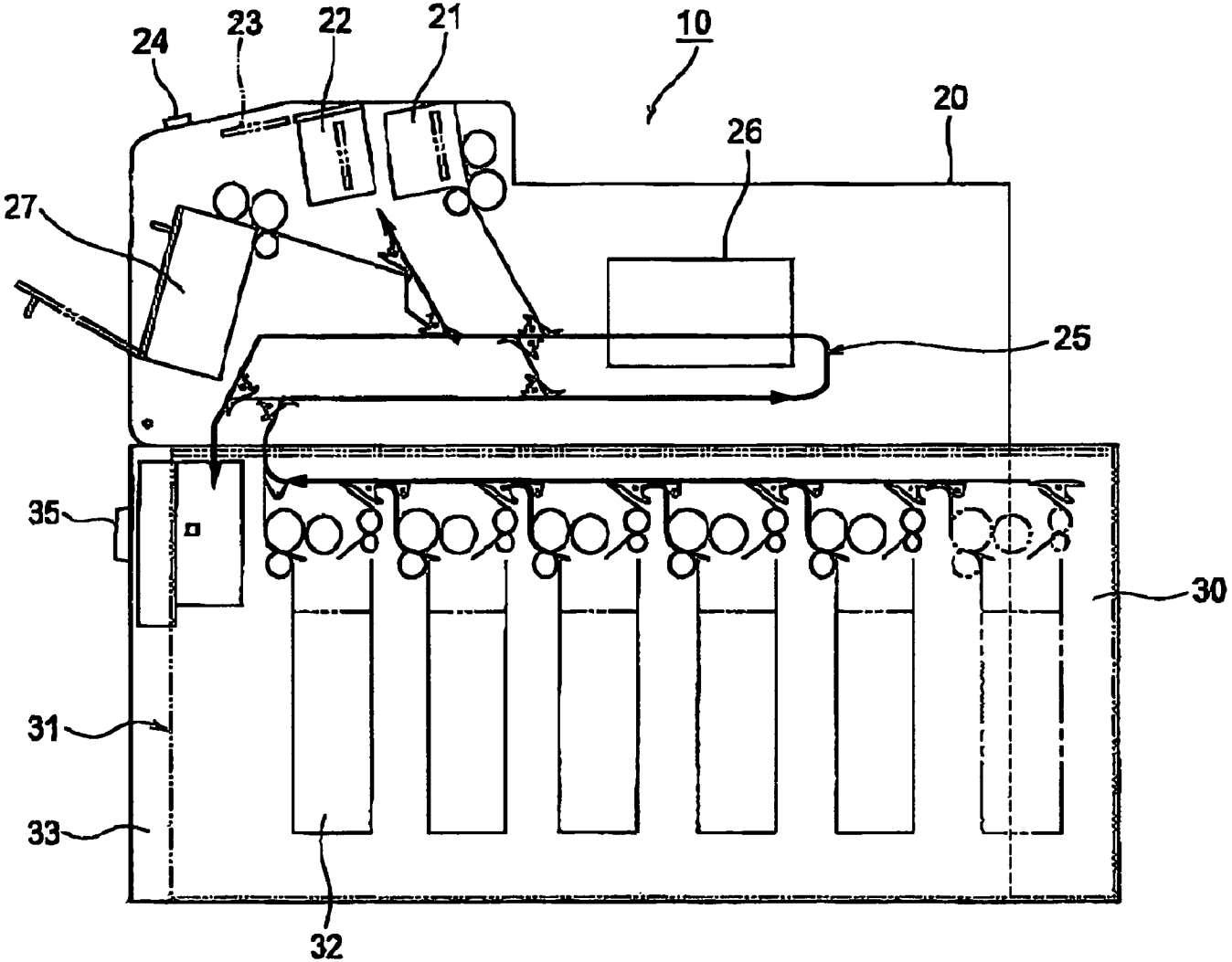
FIG. 4 is a sectional view showing an outline structure of the bill receiving/dispensing machine shown in FIG. 3.

FIG. 3 is a perspective view showing the entire outline structure of a currency receiving/dispensing machine to which the present invention is applied, and FIG. 4 is a sectional view thereof. Here, a bill receiving/dispensing machine handling only bills will be explained as an example.

The bill receiving/dispensing machine 10 includes an upper unit 20 and a lower unit 30. The upper unit 20 is provided at its upper surface with a currency receiving opening 21 from which bills to be processed are set in, a currency dispensing opening 22 from which bills are dispensed based on a currency dispensing instruction, a display section 23 on which a state and data of a device are displayed, and an operating section 24 comprising operation buttons for inputting instructions to the device. The upper unit 20 is provided therein with conveying means 25 comprising a driving mechanism and a convey path for transferring bills between various constituent elements, and an identifying section 26 for determining genuine/counterfeit, normal/damaged and kinds of currency. The upper unit 20 is also provided therein with a temporary holder 27 in which bills which were identified and counted when they were received are temporarily hold.

The lower unit 30 is a currency safe which can be pulled out. The lower unit 30 is provided therein with a plurality of bill storing sections 32 for respective kinds of bills. Bills to be received and bills to be paid are stored in the bill storing sections 32 on the kind-by-kind basis.

A door 33 provided on a front surface of the lower unit 30 can be opened when necessary. The door 33 is provided with a knob 34 and a combination lock 35 for opening the door.

In such a bill receiving/dispensing machine 10, bills set into the currency receiving opening 21 are identified by the identifying section 26, a bill which was identified as the genuine bill is collected in the temporary holder 27, and a bill which was not determined as the genuine bill is collected in the currency dispensing opening 22 as rejected bill and then, the latter bill is manually set into the currency receiving opening again by an operator and is again identified. When all of bills are collected in the temporary holder, the operator carries out the currency receiving approving instruction, and the bills in the temporary holder are transferred out into respective storing sections 32 and stored therein. When currency is to be paid, a bill taken out from the respective bill storing sections is transferred in the opposite direction from that when currency is to be received, the bills is confirmed by the identifying section 26 and then, the bills is dispensed from the currency dispensing opening 22. Since the above-described operation is well known, further detailed explanation will be omitted. Arrows in FIG. 4 show flow of bills when currency is paid.

Figure 5:
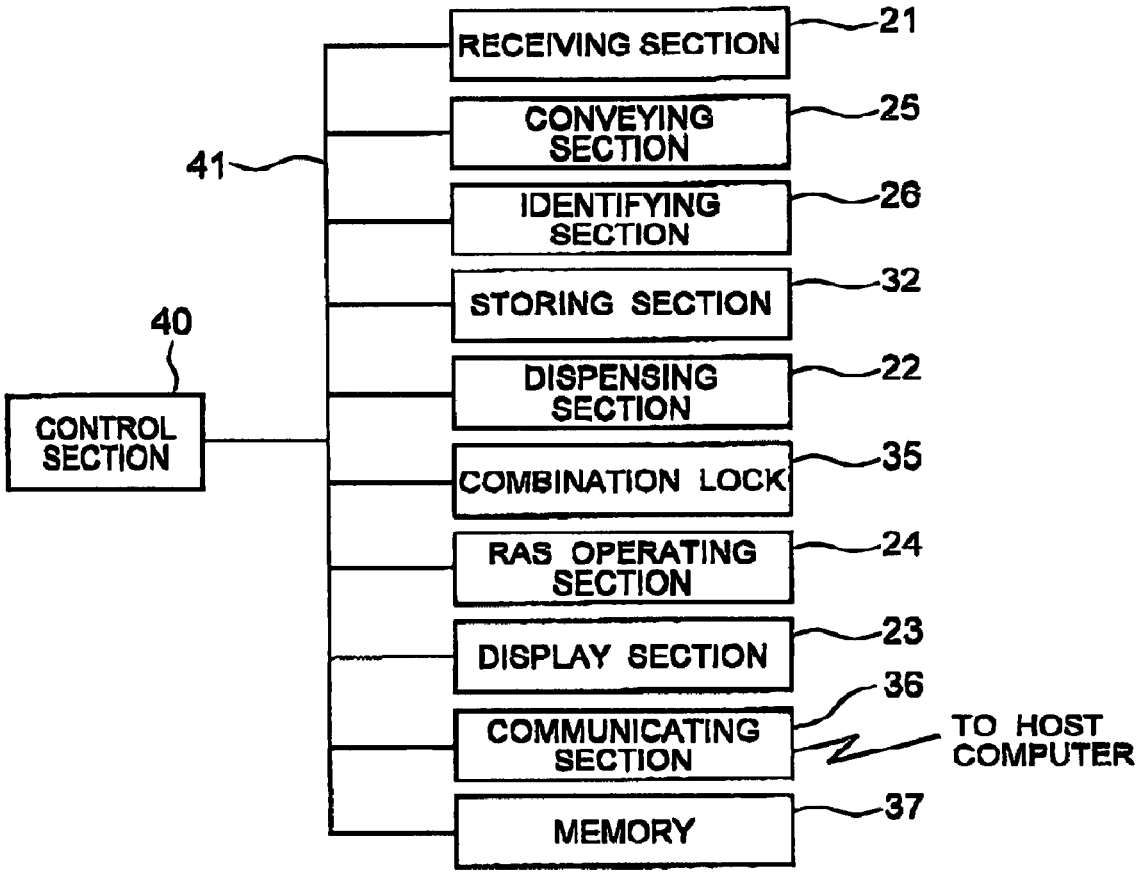
FIG. 5 is a block diagram showing an outline structure of the bill receiving/dispensing machine shown in FIG. 3.

As shown in FIG. 5, the above-explained elements are connected to control means 40 which is a microcomputer or the like through a bus 41. A communicating section 36 for sending and receiving information between the microcomputer and a host computer or the like, and a memory means 37 are connected to the bus. Various data sets in the device such as a remaining amount in each storing section are stored in the memory means 37.

Figure 6:
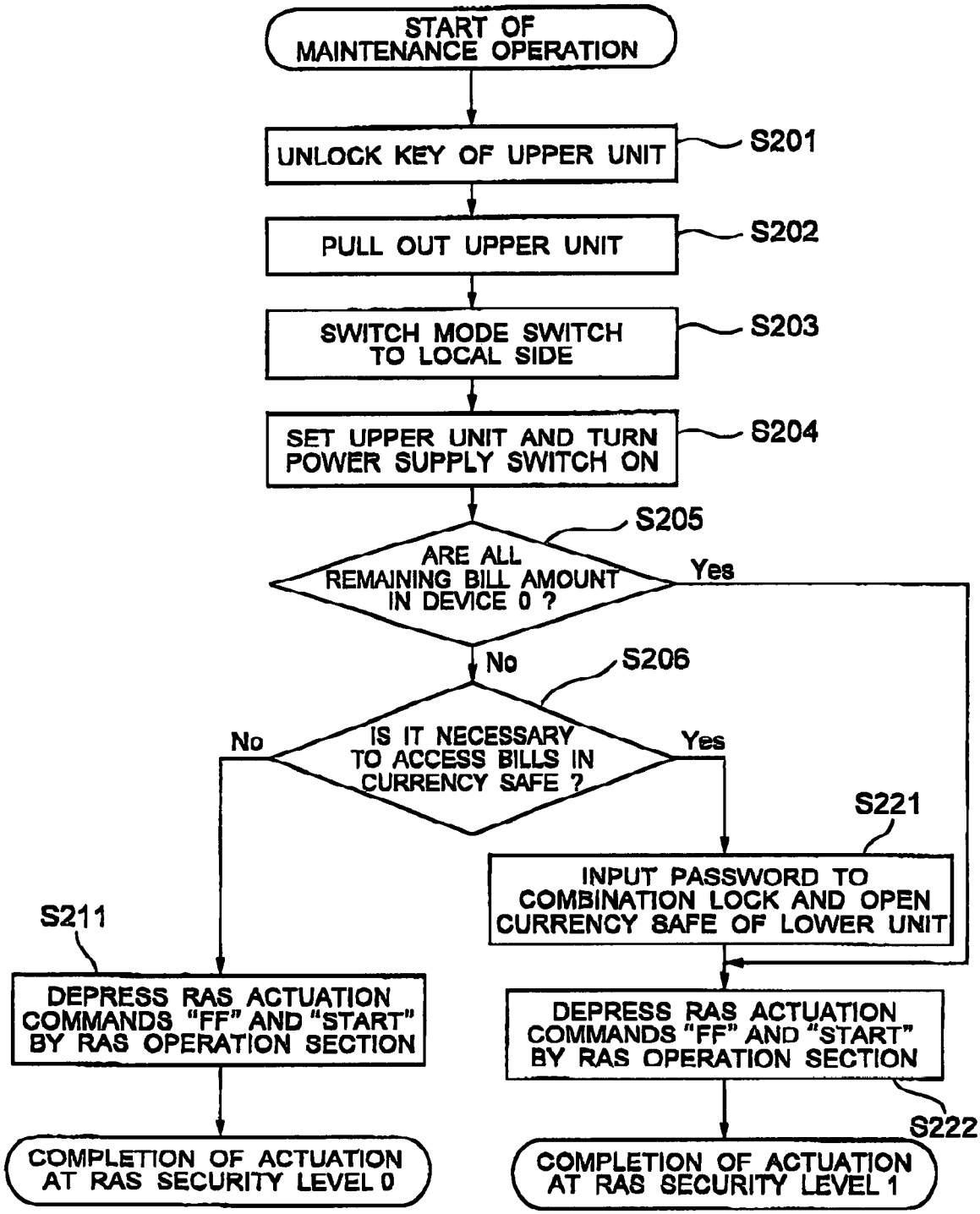
FIG. 6 is a flowchart showing procedure of a maintenance operation in an RAS mode according to the present invention.

Next, a maintenance operation in an RAS mode which is characteristic of the present invention will be explained with reference to a flowchart in FIG. 6.

First, an upper unit key borrowed from a banker is inserted to unlock the key which fixes the upper unit to the body (step S201).

With this, the upper unit can be pulled out and thus, the upper unit is pulled out (step S202).

Figure 7:
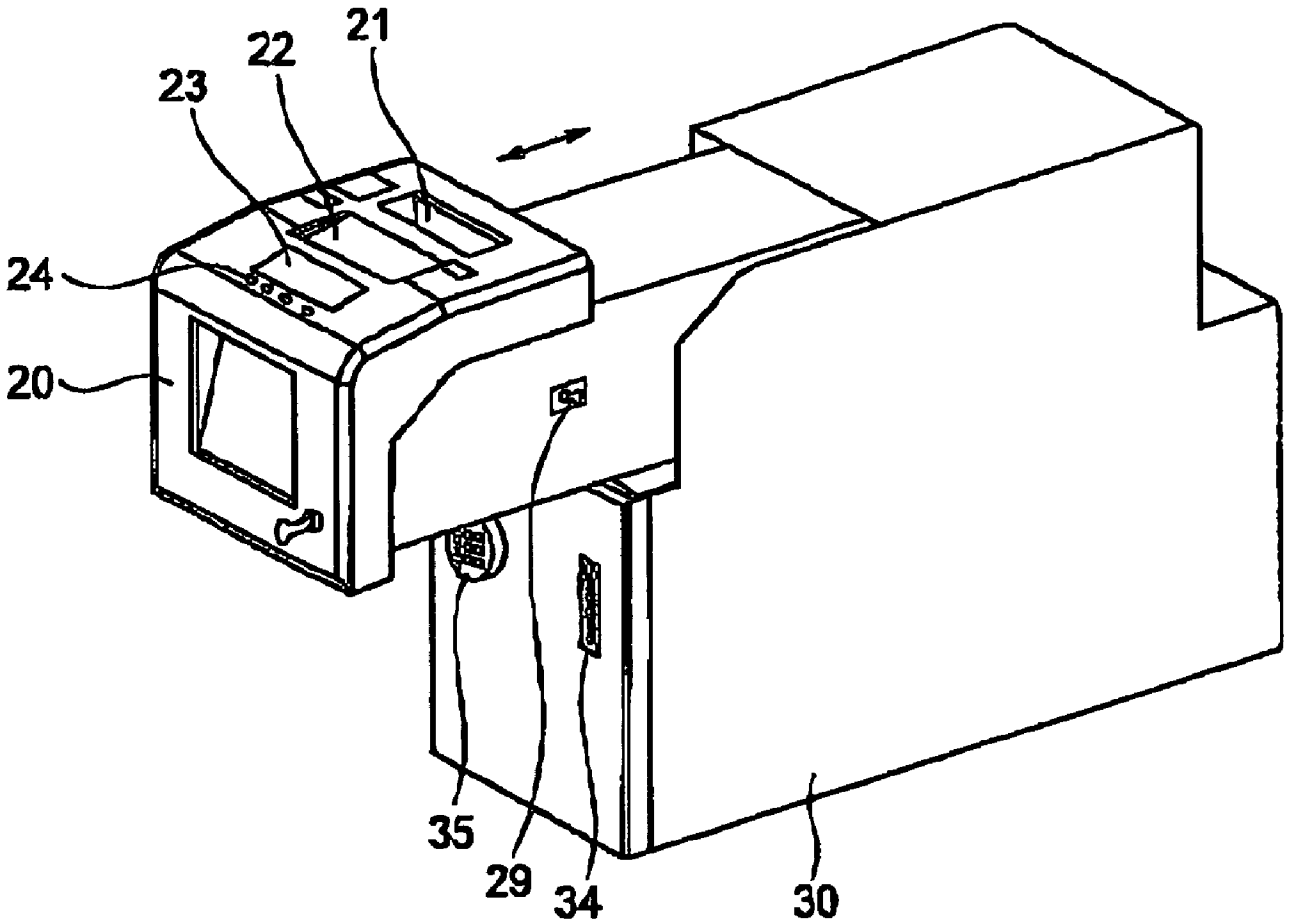
FIG. 7 is a perspective view showing a state in which an upper unit is pulled out in a maintenance mode.

FIG. 7 is a perspective view showing a state where the upper unit 20 is pulled out for carrying out the maintenance operation, and a remote/local mode switch 29 appears.

A remote/local mode switch is switched to the local side (step S203).

The upper unit 20 is returned into the body and set, and a power supply switch is turned ON (step S204).

Thereafter, processing in which the security level is taken into account is carried out. In the present invention, there are a plurality of security levels, and the security levels can be switched over in accordance with contents of the maintenance operation. This is because that when the maintenance person carries out maintenance of the device, the fact that there are many commands in which the maintenance person need not touch cash with his hand is taken into account.

That is, in this embodiment, the number of security levels is two, i.e., a security level 0 which is an RAS level that can be operated even when there is no cash manager (banker or the like), and a security level 1 which is an RAS level that can not be operated if there is no cash manager. In the security level 1, it is possible to use a currency dispensing command and a command for clearing RAM contents.

First, it is determined whether all of bill remaining values in the device are 00 by referring the remaining value stored in the memory means 37 (step S205). If all of the bill remaining values are 0, the procedure is proceeded to step S222. If the RAS actuation commands "FF" and "START" are depressed in the RAS operating section, the actuation of the RAS security level 1 is completed. This is because that in this case, since no bills exists in any of the device, there is no need to worry about theft or the like.

In this security level 1, all of commands can be used. It is possible to determine whether there is a bill in the device only based on the remaining value in the storing means. Thus, a RAM clearing command capable of bringing the remaining value into 0 can be used only in the security level 1. However, when the remaining value is 0 from the beginning, there is no actual damage even if this command can be used.

When a value of any one of bill counters in the device is not 0, it is determined whether it is necessary to access the bill in the currency safe (step S206).

When it is unnecessary to access the bill in the currency safe, the procedure is proceeded to step S211, and the RAS actuation commands "FF" and "START" are depressed in the RAS operating section. With this the actuation of the RAS security level 0 is completed.

At the security level 0, the currency safe can not be opened, the currency dispensing command and the remaining value clearing command in the storing means can not be used, That is, currency receiving commands for receiving bills from the currency receiving opening 21, or for collecting bills in the temporary holder 27 or for returning bills in the temporary holder 27, but a collection command and a currency dispensing command for throwing out bills in the currency safe into the currency dispensing opening 22 are not accepted.

When it is necessary to access bills in the currency safe, the combination lock is unlocked by inputting a password by a banker so that the currency safe door of the lower unit can be opened and closed (step S221). If the RAS actuation commands "FF" and "START" are instructed by the RAS operating section (step S222), the actuation of the RAS security level 1 is completed. At this level, it is possible to use all of RAS commands including a command for bringing bills in the currency safe in and out including currency reception and currency payment.

In the RAS security level 1, a banker who unlocks the combination lock must attend when the operation is continued so that bills are not lost.

In order to turn OFF the power supply after the level is shifted to the RAS security level 1, and to again turn ON the power supply, it is again necessary to unlock the combination lock in the same manner as that described above.

FIG. 8 are explanatory diagrams of display contents on the display section 23 by operation of the operating section 24.

As shown in FIG. 8, the display section 23 includes a state display section 23*a* for displaying a state of the device, a command display section 23*b*, an RAS data display section 23*c*, and a function display section 23*d* of a push button at the time of the RAS mode.

Figure 8A:
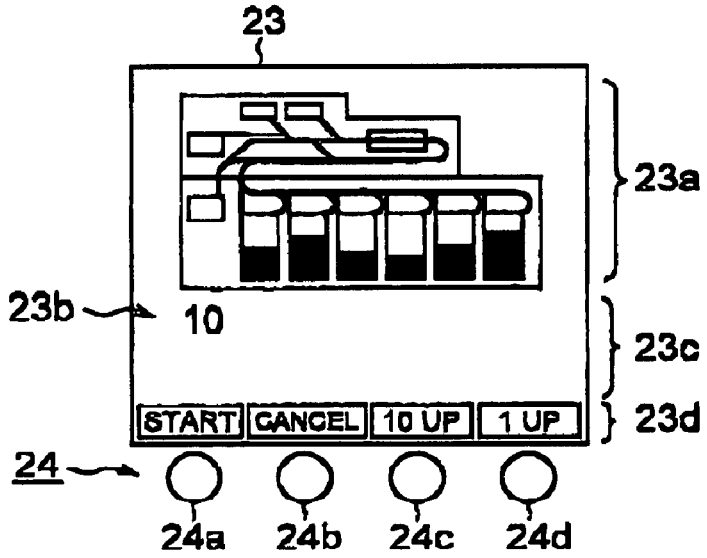
FIG. 8 are explanatory diagrams showing display examples on a display section in the RAS mode of the invention.
Figure 8B:
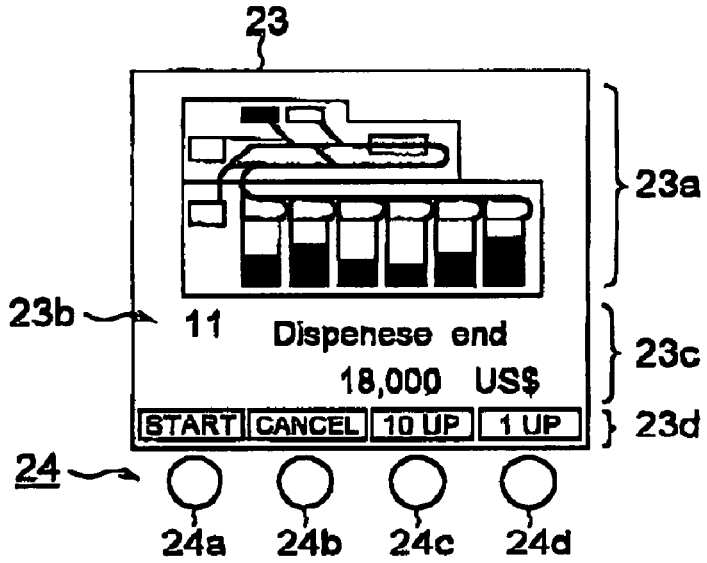
Figure 8C:
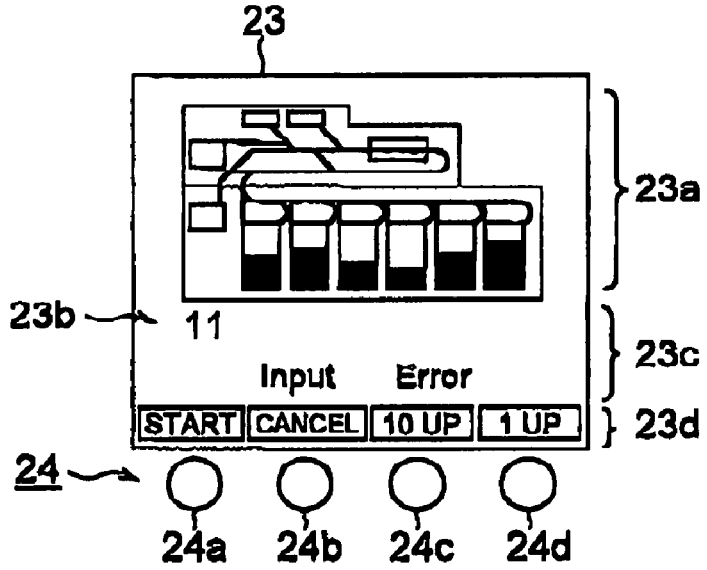

The state display section 23*a* shows a bill amount in each portion of the schematic device by means of an amount of black portion. Not only each storing section, but also when bill exists in each of the currency receiving opening, currency dispensing opening and temporary holder is also shown in black color. For example, FIGS. 8A and 8C show that bills exist only in the storing section, and FIG. 8B shows that bills exist also in the currency dispensing opening.

The command display section 23*b* displays numbers of commands. Examples of the RAS commands are as follows:

11: currency dispensing

12: collection

13: clear remaining value

Examples of currency receiving commands are as follows:

21: currency receiving

22: supplement

23: storage of bills in temporary holder

When these commands are to be designated, push buttons located below the display section 23 are operated. Functions of the push buttons are varied depending upon modes. At the time of the RAS mode, these push buttons are arranged in the following order from left to right: a start button 24*a*, a cancel button 24*b*, a 10 UP button 24*c* for increasing the ten's place, and a 1 UP button 24*d* for increasing the unit's place. Therefore, if the 10 UP button 24*c* is depressed, the command 10 is displayed on the command display section 23*b* as shown in FIG. 8A, and if the 1 UP button 24*d* is depressed, the command 11 is displayed as shown in FIG. 8B.

FIG. 8B shows a state where the start button 24*a* is depressed to execute the command 11 in the state of the RAS security level 1.

At the RAS security level 1, to receive the currency dispensing command, the fact that the predetermined number of bills are paid and the payment is completed for each kind of currency, and the paid amount are displayed on the RAS data display section 23*c*. In the case of this example, it is shown that 18000 US dollars are paid and the payment is completed.

Whereas, FIG. 8C shows a case where the start button 24*a* is depressed for the currency dispensing command (command 11) in a mode of the RAS security level 0.

In the case of the mode of the RAS security level 0, since the currency dispensing command is prohibited, "Input Error" is displayed on the data display section 23*c*, and commands thereafter are not received. In this case, a cause of the error is not displayed to maintain the security.

As described above, the embodiment has two RAS security levels, i.e., the level at which maintenance of the device can be carried out without restraining a banker in time, and the level at which the device can not be started unless a banker does not attend when accessing bills stored in the currency safe of the device. Therefore, normal maintenance operation can be carried out without restraining the banker in time, and when there is cash in the currency safe of the device, maintenance operation is carried out while the cash manager attends and operates and strict cash management can be carried out, and a bank side person can reliably leave the maintenance operation to a maintenance person.

Although the present invention has been explained based on the embodiment, the invention can variously be modified within a range defined by patent claims.

For example, the number of security levels is two in the embodiment, three or more security levels may be set.

The invention claimed is:

1. A currency receiving/dispensing machine comprising:

an upper unit having a currency receiving opening, identifying means for taking in currency set in the currency receiving opening and for identifying the currency, a currency dispensing opening through which the currency is dispensed based on a currency dispensing instruction, mode designating means for switching and designating various operation modes, and a lower unit having currency storing sections for storing the currency in a predetermined section based on a currency receiving approving instruction and a result of identification of the identifying means, wherein the currency receiving/dispensing machine has two kinds of maintenance modes for carrying out maintenance and inspection of the currency receiving/dispensing machine designated by the mode designating means, the two kinds of maintenance modes comprises a first maintenance mode for only the upper unit in which currency can not be taken out from the currency storing section, and a second maintenance mode for both of the upper unit and the lower unit in which currency can be taken out from the currency storing section.

2. A currency receiving/dispensing machine comprising:

a currency receiving opening, identifying means for taking in currency set into the currency receiving opening and for identifying the currency, currency storing sections for storing the currency in a predetermined section based on a currency receiving approving instruction and a result of identification of the identifying means, a currency dispensing opening through which the currency taken out from the currency storing section is dispensed based on a currency dispensing instruction, and, a remaining value memory means for storing and managing a remaining value of currency in the currency storing section, wherein the currency receiving/dispensing machine has a plurality of maintenance modes, first maintenance mode designating means for designating a first maintenance mode in which currency can not be taken out from the currency storing section, second maintenance mode designating means for designating a second maintenance mode in which currency can be taken out from the currency storing section by input having higher security level than the first maintenance mode designating means, control means which permits maintenance and inspection other than the currency storing section and prohibits a currency dispensing command for transferring currency at least from the currency storing section when the first maintenance mode is designated by the first maintenance mode designating means, and which permits all of maintenance and inspections including the currency storing section and permits the currency dispensing command for transferring currency from the currency storing section when the second maintenance mode is designated by the second maintenance mode designating means, and wherein when the first maintenance mode is designated, the control means prohibits the remaining value in the remaining value memory means from being erased, and when the second maintenance mode is designated, the control means is permitted to erase the remaining value in the remaining value memory means.

3. The currency receiving/dispensing machine according to claim 2, further comprising a combination lock provided on a door portion for which opens the currency storing section such that the currency storing section can be operated, wherein the combination lock locks and unlocks the door portion by inputting a password, and the second maintenance mode designating means is an input of the password to the combination lock.

4. The currency receiving/dispensing machine according to claim 2, wherein even when the first maintenance mode is designated, if all of the remaining values in the remaining value memory means are zero, the control means permits the currency dispensing command for transferring currency from the currency storing section like a case in which the second maintenance mode is designated.

5. The currency receiving/dispensing machine according to claim 3, wherein if a power supply is once turned OFF in the second maintenance mode, in order to shift the mode to the second maintenance mode again, it is necessary to designate the first and second maintenance modes.

6. A currency receiving/dispensing machine comprising:

a currency receiving opening, identifying means for taking in currency set in the currency receiving opening and for identifying the currency, currency storing sections for storing the currency in a predetermined section based on a currency receiving approving instruction and a result of identification of the identifying means, a currency dispensing opening through which the currency taken out from the currency storing section is dispensed based on a currency dispensing instruction, mode designating means for switching and designating various operation modes and a remaining value memory means for storing and managing a remaining value of currency in the currency storing section, wherein said mode designating means can designate either one of two maintenance modes, one mode for prohibiting the remaining value in the remaining value memory means from being erased, or the other mode for permitting the remaining value in the remaining value memory means from being erased.

* * * * *